United States Patent [19]

Okada

[11] 4,418,253

[45] Nov. 29, 1983

[54] TWO-SPEED TIMER

[75] Inventor: Akio Okada, Ida, Japan

[73] Assignee: Kabushiki Kaisha Sankyo Seiki Seisakusho, Nagano, Japan

[21] Appl. No.: 243,160

[22] Filed: Mar. 12, 1981

[30] Foreign Application Priority Data

Mar. 18, 1980 [JP] Japan ..... 55-36923[U]

[51] Int. Cl.[3] ..... H01H 43/10

[52] U.S. Cl. ..... 200/35 R; 200/38 R

[58] Field of Search ..... 200/35 R, 38 R, 38 FA

[56] References Cited

U.S. PATENT DOCUMENTS 3,991,289 11/1976 Weber ..... 200/35 R X

*Primary Examiner*—J. R. Scott

*Attorney, Agent, or Firm*—Sughrue, Mion, Zinn, Macpeak and Seas

[57] ABSTRACT

A two-speed timer in which both long and short timing periods can be set with only a moderate force imposed upon a time set shaft. The time set shaft is engageably coupled to a reduction gear train which is coupled to be rotated by an electric motor. A disc having a single engagement tooth portion at a predetermined position on the circumferential portion thereof is mounted on the time set shaft. A driven gear cooperating with the engagement structure has a change-over surface formed at an upper end thereof. A speed change gear is positioned on the same shaft upon which the driven gear is rotatably mounted and is urged into contact with the change-over surface. The speed change gear engages with a selected gear portion of the reduction gear train in dependence upon the rotational position of the driven gear so as to vary the rotational speed of the set shaft.

9 Claims, 7 Drawing Figures

TWO-SPEED TIMER

BACKGROUND OF THE INVENTION

The present invention relates to a two-speed timer.

In timer switches having a maximum set time of, for example, 60 minutes or 120 minutes, it is difficult to set a short operation period, for example, 30 seconds or one minute, because the angle of rotation of the set shaft of the timer is very small for such relatively short periods. Because of this limitation, there have generally been provided two stage timer switches in which the rotational angle of the set shaft, and accordingly the scale thereof, is broadened for such short time settings.

An example of a prior art timer of this general type will be described with reference to FIG. 1. In this timer, a cam wheel b is secured to a set shaft a. The cam wheel has a recess portion related to high speed operation and a convex portion related to low speed operation. A speed change lever c is in frictional contact with the cam wheel. According to the rotation of the set shaft a, when the speed change lever c is in contact with the recess portion of the cam wheel, an idler gear d mounted on the speed change lever c is engaged with a drive reduction gear e, whereas when the speed change lever c is in contact with the convex portion of the cam wheel, the idler gear is disengaged from the reduction gear to thereby perform a change-over of speed.

In such a timer switch, the maximum rotational angle of the set shaft is generally about 300° with the speed change angle being about 200°. If it is desired to change the speed change angle, it is possible to do so by modifying the timer by using a common cam wheel only in the range of ±30°. However, beyond this range, an entirely different cam must be manufactured.

In the prior art timer, since the engagement and disengagement between the idler gear d and the reduction gear e are carried out by a radial movement, a strong coil spring f must be used in order to obtain a sufficient engagement pressure between the gears. This leads to a requirement that a great amount of rotational force or torque be used for operation of the set shaft a. At the same time, when the lever c is moved against the spring force, a high load is imposed on the motor (not shown).

Accordingly, an object of the present invention is to provide a timer with a simpler construction than the prior art device and to provide a timer which overcomes the above-noted drawbacks.

SUMMARY OF THE INVENTION

In accordance with these and other objects of the invention, a two-speed timer is provided which includes a time set shaft engagably coupled to reduction gear means which is rotated by an electric motor. A disc having a single engagement means at a predetermined position on a circumferential portion thereof is mounted on the time set shaft. A driven gear cooperates with the engagement means with the driven gear having a change-over surface formed at an upper end thereof. A speed change gear is positioned in contact with the change-over surface and is engaged with the reduction gear means. The speed change gear is slidable on the change-over surface in dependence upon the position of the driven gear whereby the rotational speed of the set shaft is varied depending upon which of the reduction gear portions of the reduction gear train the speed change gear is engaged with. The circumferential portion of the disc serves as a locking means for the engagement means.

DESCRIPTION OF THE PREFERRED EMBODIMENTS

Figure 1:
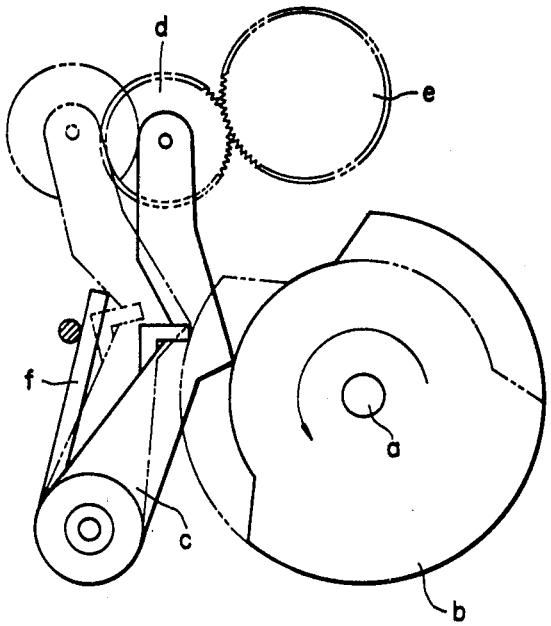
FIG. 1 PRIOR ART
FIG. 1 is a schematic illustration of a prior art two-speed timer.
Figure 2:
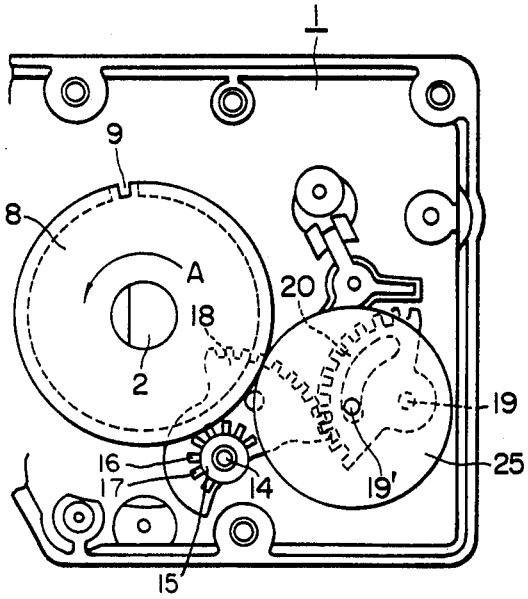
FIG. 2 is a plan view of a two-speed timer according to the present invention.
Figure 3:
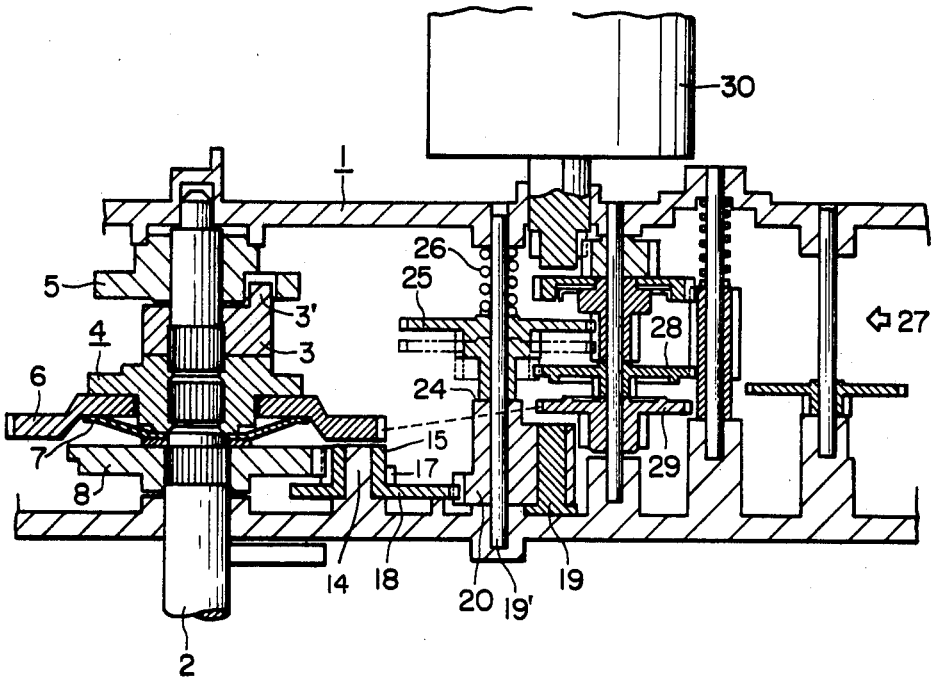
FIG. 3 is a cross-sectional view of the timer shown in FIG. 2.

The present invention will now be described in detail with reference to the accompanying drawings. Referring to FIGS. 2 and 3, reference numeral 1 denotes a substrate case encasing timer gear trains and 2 denotes a time set shaft supported on the case 1. Bushings 3 and 4 are fixedly mounted in a multi-layer arrangement on the set shaft 2 through knurled portions formed in the set shaft 2. A projection 3' is formed on an upper surface of the bushing 3 which is engaged with a cam member 5 against which a lever (not shown) contacts, the lever setting a switch strip (not shown) to an on or off position.

Figure 5:
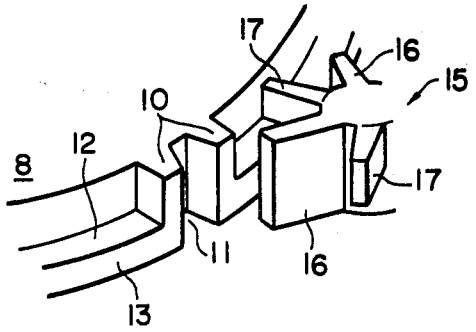
FIG. 5 is a perspective view of the engagement structure shown in FIG. 4.

On the other bushing 4 through a frictional transmission member 7 is connected a main gear 6 which is engaged with the set shaft 2. On the set shaft 2 is fixedly mounted a speed change disc 8 which has an engagement tooth structure 9 at a circumferential position thereof. As best shown in FIG. 5, the engagement tooth structure 9 includes a pair of teeth 10 and a recess 11 defined by the teeth 10. A non-tooth portion 12 has a horizontal flat portion defined between a base circle and a tip circle of the teeth 11. The end surface corresponding to the tip circle serves as a locking disc 13 described later.

Figure 4:
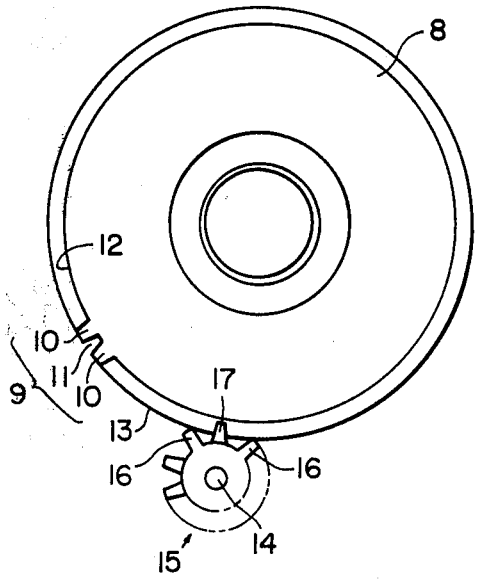
FIG. 4 is an enlarged plan view of an engagement structure used in the timer shown in FIGS. 2 and 3.

As shown in FIG. 4, the peripheral surface of the disc 8 confronts a medium gear 15 mounted on a shaft 14. The medium gear 15 has alternating narrow teeth 17 and wide teeth 16 (see FIG. 5). The narrow teeth 17 are positioned on the non-tooth portion 12 while the wide teeth 16 are positioned so as to be brought into frictional contact with the locking disc 13. When the teeth 10 of the engagement structure 9 are disengaged from the medium gear 15, that is, when no wide tooth 16 is engaged with the recess 11, the circumferential surface of the locking disc 13 of the disc 8 stops the medium gear 15. The medium gear 15 is integrally formed with a transmission gear 18 which engages a driven gear 20 supported by a shaft 19.

Figure 6:
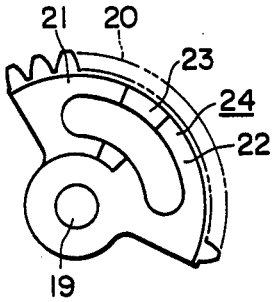
FIG. 6 is an enlarged plan view of a driven gear used in the timer of FIG. 2.
Figure 7:
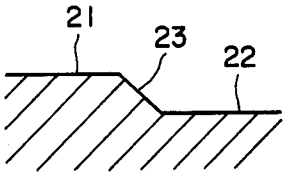
FIG. 7 is an illustrative developed view of a change-over surface of the driven gear shown in FIG. 6.

As best shown in FIGS. 6 and 7, an upper surface of the driven gear 20 includes a high level surface 21, a low level surface 22 and a slanted surface 23 connecting the surfaces 21 and 22 to thereby form a change-over surface 24 on which a speed change gear 25, supported on a shaft 19', of the driven gear 20 is rotatably and slidably mounted. The speed change gear 25 is normally biased to move toward the change-over surface 24 by a spring 26.

The speed change gear 25 is moved up and down on the change-over surface 24 along the support shaft 19' wherein the gear 25 is engaged with or disengaged from a gear element 28 of a reduction gear train 27. As a result, an output gear 29 of the reduction gear train is varied in speed in dependence on the position of the speed change gear 25. Since the main gear 6 is in fact engaged with the output gear 29 as indicated by a dotted line, the main gear 6 is rotated at a speed determined by the position of the speed change gear 25. Reference numeral 30 denotes an electric motor.

In operation, when the set shaft 2 is rotated through a large angle in the direction A in FIG. 2 for a long operational time setting, for example, 60 or 120 minutes, the disc 8 is rotated together with the set shaft 2. When the disc 8 of the set shaft 2 is engaged with the medium gear 15, the transmission gear 18 is rotated at a predetermined rate so that the driven gear 20 is also rotated and the speed change gear 25 is positioned on the low level surface 22 as depicted by a two dot-chain line in FIG. 3. As a result, the speed change gear 25 is engaged with the gear 28 of the reduction gear train 27 to change the gear transmission ratio.

When the set shaft 2 is rotated past the medium gear 15, the wide teeth 16 are again in contact with the locking disc 13 and hence rotation of the medium gear 15 is prevented. Accordingly the change-over state of the speed change gear 25 is maintained.

Since the cam member 5 maintains the switch (not shown) closed during the rotation of the set shaft 2, an electric voltage is applied to the motor 30.

When setting of the set shaft 2 to a desired period of time is completed, the reduction gear train is driven by the motor. Since the reduction gear train is already then in the change-over mode, the main gear 6 is slowly rotated by the output gear 29 of the gear train. Therefore, it is possible to set the set shaft to a desired long time period setting without hindrance.

Subsequently, when the engagement tooth structure 9 is again engaged with the medium gear 15 upon rotation of the disc 8 in the return direction, the driven gear 20 is rotated and the speed change gear 25 is again positioned on the high level surface 21 of the change-over surface 24. Therefore, the speed change gear 25 is engaged with the reduction gear train 27 as shown in FIG. 3 by a solid line. As a result, the output gear 29 allows the set shaft 2 to rotate at a high speed through the main gear 6. Therefore, it is possible to rotate the set shaft to a desired short time period setting without hindrance.

When the set shaft 2 is returned to the zero position, the switch retained by the cam member is opened and the motor is stopped.

As mentioned above, since the engagement tooth structure is positioned at a single position on the circumferential surface of the set shaft, it is possible to change the relative rotational angle of the set shaft to the disc to any angle within the range of 360°. This means that the invention can fulfill a variety of different timer requirements.

Furthermore, the engagement tooth structure 9 cooperates with the driven gear 20 having the change-over surface 21-24 and the driven gear 20 is slidably moved along the shaft by the movement on the change-over surface. By the sliding movement, the rotational speed of the set shaft is changed over while engagement with the reduction gear train is maintained and the speed change gear is rotated in contact with the change-over surface. Specifically, the disengagement of the speed change gear from the reduction gear train is achieved by the movement in the axial direction. The force required to set the shaft is much smaller than that needed by prior art two-speed timers.

What is claimed is:

1. A two-speed timer assembly comprising:

a time set shaft;

reduction gear means;

means for coupling said time set shaft to an output of said reduction gear means so that said reduction gear means drives said time set shaft;

an electric motor;

means for coupling said electric motor to said reduction gear means to rotate said reduction gear means;

a disc having engagement means at a position on a circumferential portion thereof, said disc being mounted on said time set shaft;

a driven gear cooperating with said engagement means and having a change-over surface a speed change gear positioned in contact with said change-over surface, and being slidable on said change-over surface, means for biasing said speed change gear toward said change-over surface, said speed change gear being selectively engaged with gears in said reduction gear means to vary a rotational speed of said output of said reduction gear means and said time set shaft.

2. The timer assembly as defined in claim 1 further comprising locking means located on said circumferential portion of said disc for selectively locking said driven gear for preventing rotation thereof.

3. The timer assembly as defined in claim 1 wherein said change-over surface is formed at an upper end surface of said driven gear, said change-over surface including a high level and a low level surface interconnected by a slanting surface.

4. The timer assembly as defined in claim 1 wherein said rotation of said driven gear causes said speed change gear to move in an axial direction.

5. A two-speed timer assembly comprising:

a time set shaft;

a main gear mounted on said time set shaft;

a frictional transmission member for engaging said main gear to said time set shaft;

a speed change disc mounted on said time set shaft to rotate therewith, said speed change disc having a single tooth engagement structure formed on a peripheral surface thereof;

a transmission gear rotatably mounted adjacent said speed change disc, said transmission gear having an upper gear portion disposed to engage with said engagement structure of said speed change disc at a predetermined rotational angle of said time set shaft and a lower gear portion;

a driven gear rotatably mounted on a second shaft, said driven gear having gear teeth engaged with said lower gear portion of said transmission gear, said driven gear having a change-over surface formed at an upper end thereof, said change-over surface having upper and lower portions;

a third shaft;

a speed change gear rotatably and slidably mounted on said third shaft, a lower end of said speed change gear being in contact with said change-over surface wherein a vertical position of said speed change gear on said third shaft is determined in accordance with a rotational position of said driven gear;

a spring for urging said speed change gear into contact with said change-over surface of said driven gear;

a reduction gear train rotatably mounted on a fourth shaft adjacent said second shaft, said speed change gear being engaged with different gear portions of said reduction gear train in dependence upon said vertical position of said speed change gear along said third shaft; and an output gear rotatably mounted on said fourth shaft and coupled to be rotated by said reduction gear train, said main gear being engaged with said output gear.

6. The timer assembly as defined in claim 5 wherein said engagement structure of said speed change disc comprises two teeth and wherein said disc has a horizontal flat portion defined between a base circle and a tip circle of said teeth.

7. The timer assembly as defined in claim 5 or 6 wherein said transmission gear has an upper medium gear portion having alternating narrow and wide teeth, said wide teeth being shaped and disposed so as to engage with said teeth of said engagement structure of said speed change disc.

8. The timer assembly as defined in claim 5 or 6 further comprising an electric motor and means for coupling said electric motor to said reduction gear train.

9. The timer assembly as defined in claim 5 or 6 further comprising bushing means coupled to said time set shaft, said bushing means being engaged with a cam member for operating a switch in dependence upon the rotational position of said time set shaft.

* * * * *